US009784535B1

(12) United States Patent
Cheng et al.

(10) Patent No.: US 9,784,535 B1
(45) Date of Patent: Oct. 10, 2017

(54) SIGHT ADJUSTMENT TOOL

(71) Applicants: Carson Cheng, City of Industry, CA (US); Changan Tian, City of Industry, CA (US); Richard Thomas, City of Industry, CA (US)

(72) Inventors: Carson Cheng, City of Industry, CA (US); Changan Tian, City of Industry, CA (US); Richard Thomas, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 15/093,719

(22) Filed: Apr. 7, 2016

(51) Int. Cl.
*F41G 1/54* (2006.01)
*F41C 3/00* (2006.01)

(52) U.S. Cl.
CPC ..... *F41G 1/545* (2013.01); *F41C 3/00* (2013.01)

(58) Field of Classification Search
CPC ..... F41G 1/54; F41G 1/545
USPC ..... 42/108
See application file for complete search history.

(56) References Cited

U.S. PATENT DOCUMENTS 4,683,801 A * 8/1987 Palazzolo ..... F41A 23/50 89/40.12
5,864,957 A * 2/1999 Small ..... F41G 1/54 42/111
D622,807 S * 8/2010 Stone ..... D22/199
D675,698 S * 2/2013 Bietsch ..... D22/108
8,397,422 B2 * 3/2013 Bietsch ..... F41G 1/545 33/274
8,707,609 B2 * 4/2014 Fisher ..... F41C 27/00 33/274
2011/0252688 A1 * 10/2011 Bietsch ..... F41G 1/545 42/90
2013/0255128 A1 * 10/2013 Fisher ..... F41C 27/00 42/108
2016/0252323 A1 * 9/2016 Gomez ..... F41G 1/545 42/108

OTHER PUBLICATIONS

Wheeler Engeineering Armorer's Handgun Sight Tool, Battenfeld Technologies Inc., https://www.youtube.com/watch?v=R5phKttc8cM, Mar. 9, 2016 (approximate storyline provide in .pdf form).*

* cited by examiner

*Primary Examiner* — Derrick Morgan
(74) *Attorney, Agent, or Firm* — Raymond Y. Chan; David and Raymond Patent Firm

(57) ABSTRACT

A sight adjustment tool includes a surrounding frame and a sight adjustment module. The surrounding frame including two side members and a top member to define an adjustment cavity. The sight adjustment module includes a base platform movably supported within the adjustment cavity in an elevated direction for adjustably supporting a bottom of a pistol slide, two side clampers movably extended from the side members respectively to the adjustment cavity for biasing against two sides of the pistol slide respectively, and a sight adjuster including an adjusting jaw movably supported by a sight adjusting arm and suspendedly supported within the adjustment cavity for engaging with the sight element, wherein when the sight adjusting arm is rotated, the adjusting jaw is driven to slide along the sight adjusting arm for selectively adjusting the position of a sight element with respect to the pistol slide.

20 Claims, 6 Drawing Sheets

SIGHT ADJUSTMENT TOOL

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a device for adjusting a sight on a firearm, and more particularly to a sight adjustment tool, which is a universal adjustment tool for adjusting, a sight element on different types or size of pistols.

Description of Related Arts

Due to normal wear and tear of a pistol or any inadvertent impact thereof, a sight element mounted at the front end and/or the rear end of a pistol barrel may be misaligned. As a result, the shooter may missed shoot the target via the misaligned sigh element. Therefore, it would be desirable to re-adjust the position of the sight element frequently.

A conventional sight adjustment tool generally comprises a rectangular frame, an attachment clip provided at a base portion of the frame to attach onto a supporting surface so as to retain the frame in position, and a pushing unit provided at a top portion and two side portions of the frame to clamp the pistol barrel within the frame. In particular, the pushing unit comprises a top pusher for movably engaging with the sight element at a top surface of the pistol barrel, and two side pushers for pressing at two side surfaces of the pistol barrel respectively. Therefore, the positions of the side pushers are adjusted to adjust the alignment of the sight element with respect to the pistol barrel. However, the conventional sight adjustment tool has several drawbacks.

Accordingly, different pistol barrels have different side surfaces. Therefore, the conventional sight adjustment tool must be particularly designed for only one type of pistol barrel to match the side pushers with the contour of the side surface of the pistol barrel. In other words, when the shooter has two different pistols, two different sight adjustment tools will be used for sight adjustment respectively. In addition, the conventional sight adjustment tool must require the supporting surface to attach the frame via the attachment clip. Therefore, the conventional sight adjustment tool must be stationary mounted on the surface in order to adjust the sight element of the pistol. In other words, the attachment clip must be provided at the bottom side of the frame for surface attachment. The frame cannot be laid flat on a surface if the surface does not provide any corresponding attachment for the attachment clip. As a result, the user may hold the frame by one hand and adjust the position of the sight element by the other hand. Also, the conventional sight adjustment tool provides limited adjustment displacements for the sight element. Accordingly, the top pusher and the side pushers can only be moved in one direction.

SUMMARY OF THE PRESENT INVENTION

The invention is advantageous in that it provides a sight adjustment tool, which is a universal adjustment tool for adjusting a sight element on different types or size of pistols.

Another advantage of the invention is to provide a sight adjustment tool, wherein top side, bottom side, and two sides of the pistol slide of the pistol are securely clamped in a stationary position in order to adjust the position of the sight element with respect to the pistol slide, so as to ensure the accuracy of the positioning adjustment of the sight element.

Another advantage of the invention is to provide a sight adjustment tool, which has a flat bottom surface to be placed on any surface for positioning adjustment of the sight element without any surface attachment. In other words, the user is able to use both hands to adjust the position of the sight element.

Another advantage of the invention is to provide a sight adjustment tool, which provides a height adjustable platform with the flat bottom surface to adjust an elevated level of the pistol slide to be retained in the adjustment cavity. Therefore, the sight adjustment tool provides different clamping directions to secure the pistol slide in position.

Another advantage of the invention is to provide a sight adjustment tool, which is easy to use to accurately adjust the position of the sight element.

Another advantage of the invention is to provide a sight adjustment tool, wherein the adjusting jaw can fit different sizes of sight elements to adjust the position thereof, such that the user does not require to change the adjusting jaw or use another adjustment tool for different pistol slides.

Another advantage of the invention is to provide a sight adjustment tool, which will not damage the sight element or the pistol slide during the operation.

Another advantage of the invention is to provide a sight adjustment tool, wherein the side inserts and the top insert are replaceable according to the contours of the top side and two sides of the pistol slide. Therefore, the user is able to simply change the side inserts and the top insert with the corresponding contouring surfaces to securely bias against the top side and two sides of the pistol slide respectively.

Another advantage of the invention is to provide a sight adjustment tool, which can also remove the sight element from the pistol slide and install the sight element to the pistol slide.

Another advantage of the invention is to provide a sight adjustment tool, wherein the adjustment operation is simple and accurate by clamping four sides of the pistol slide and by moving the sight element thereon.

Another object of the present invention is to provide a sight adjustment tool, which can be adapted to perform a wide variety of functions so as to allow widespread application of the present invention.

Another object of the present invention is to provide a sight adjustment tool, which does not require to alter the original structural design of the pistol, so as to minimize the manufacturing cost of the sight element and/or the pistol slide incorporating with the sight adjustment tool.

Another object of the present invention is to provide a sight adjustment tool, wherein no expensive or complicated structure is required to employ in the present invention in order to achieve the above mentioned objects. Therefore, the present invention successfully provides an economic and efficient solution for providing a simple and accurately adjusting configuration for selectively adjusting the position of the sight element with respect to the pistol slide.

Additional advantages and features of the invention will become apparent from the description which follows, and may be realized by means of the instrumentalities and combinations particular point out in the appended claims.

According to the present invention, the foregoing and other objects and advantages are attained by a sight adjustment tool which comprises an adjustment frame and a sight adjustment module.

The adjustment frame comprises an enlarged bottom base frame defining a flat bottom surface, and an upper surrounding frame integrally and upwardly extended therefrom. The surrounding frame comprises two side members upwardly extended from the base frame and a top member extended from the side members to define an adjustment cavity within the base frame, the side members and the top member.

The sight adjustment module comprises a base platform movably supported on the base frame within the adjustment cavity in an elevated direction for adjustably supporting a bottom of the pistol slide, two side clampers movably extended from the side members respectively to the adjustment cavity for biasing against two sides of the pistol slide respectively, and a sight adjuster. The sight adjuster comprises a sight adjusting arm rotatably extended between the side members and an adjusting jaw movably supported by the sight adjusting arm and suspendedly supported within the adjustment cavity for engaging with the sight element, wherein when the sight adjusting arm is rotated, the adjusting jaw is driven to slide along the sight adjusting arm for selectively adjusting the position of the sight element with respect to the pistol slide.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
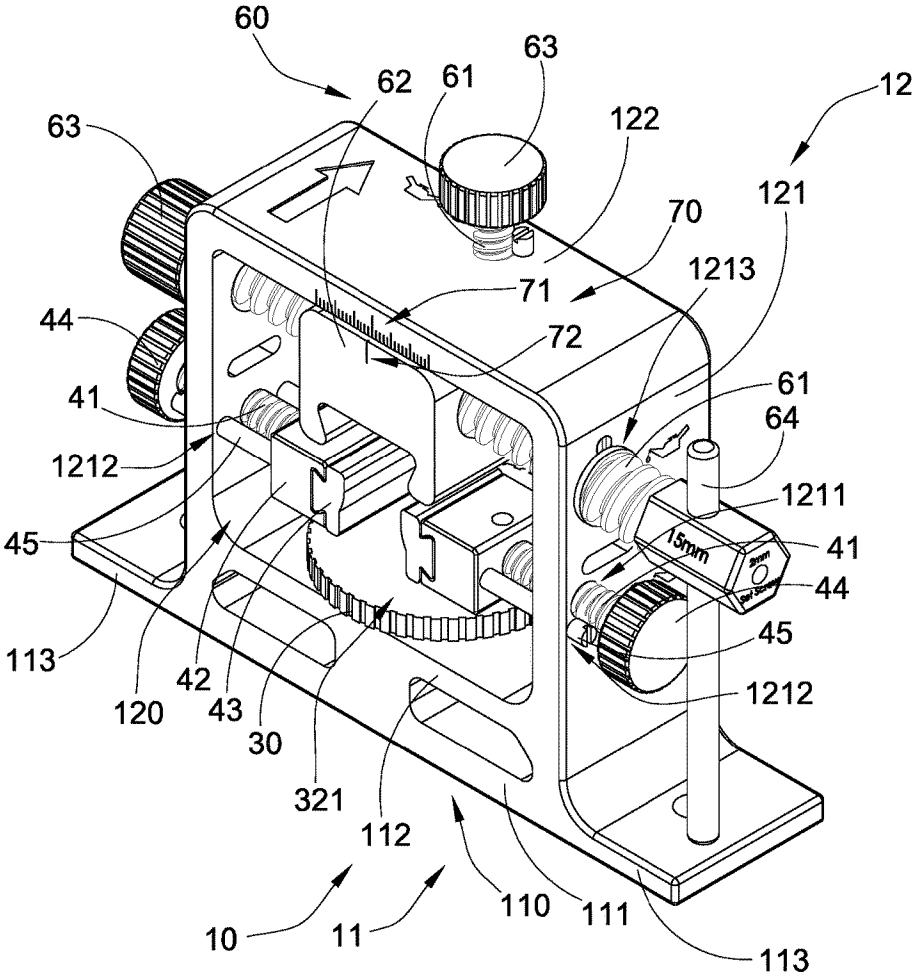
FIG. 1 is a perspective view of a sight adjustment tool according to a preferred embodiment of the present invention.
Figure 2:
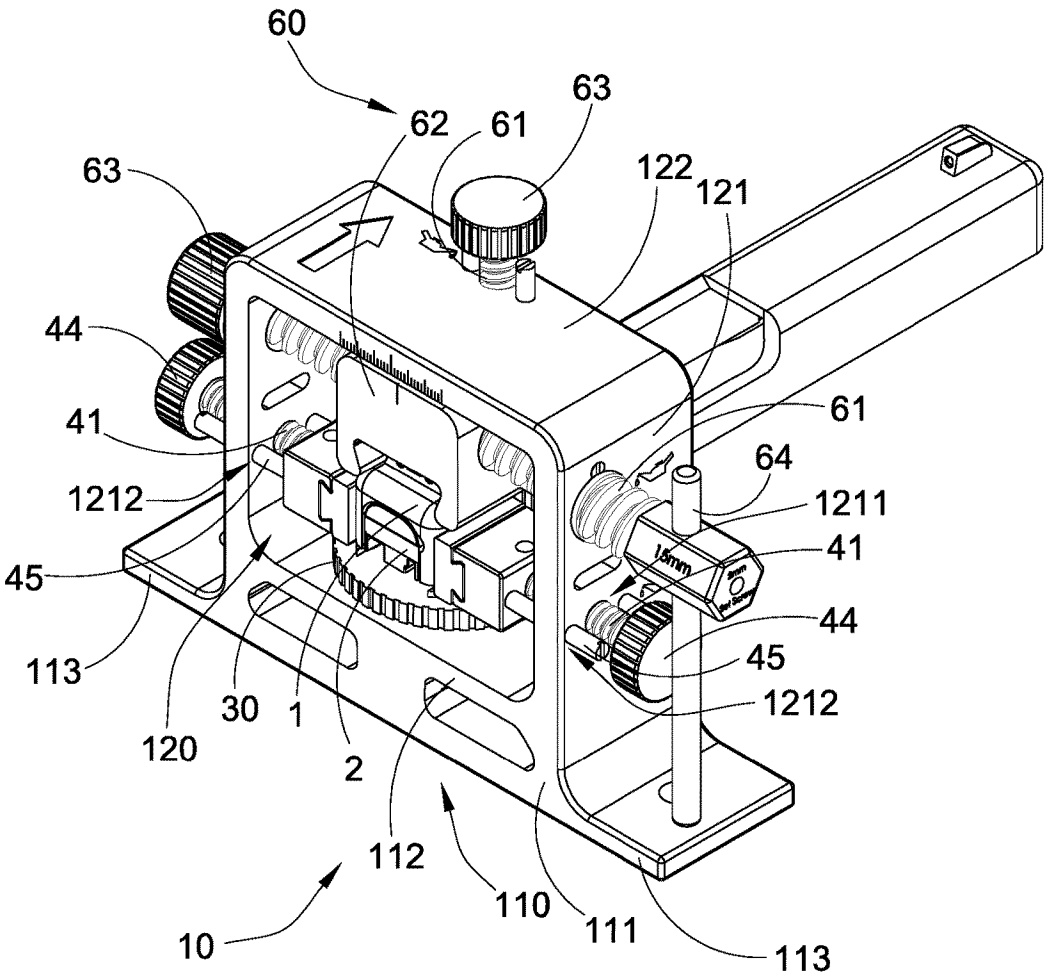
FIG. 2 is a perspective view of the sight adjustment tool according to the above preferred embodiment of the present invention, illustrating the pistol slide retained in the adjustment cavity.

As shown in FIGS. 1 and 2 of the drawings, a sight adjustment tool for adjusting a position of a sight element 1 on a pistol slide 2 of a pistol according to a preferred embodiment of the present invention is illustrated. The sight adjustment tool comprises an adjustment frame 10 and a sight adjustment module 20.

As shown in FIGS. 1 to 6, the adjustment frame 10 is made of rigid material such as metal. The adjustment frame 10 comprises an enlarged bottom base frame 11 defining a flat bottom surface 110, and an upper surrounding frame 12 integrally and upwardly extended from the base frame 11.

The base frame 11 comprises an enlarged base stand 111 to define the flat bottom surface 110 thereat, and a raised member 112 upwardly and spacedly extended from the base stand 111. Accordingly, the base stand 111 is extended parallel to the raised member 112 to define a reinforcing cavity therebetween. In particular, the base stand 111 has two wing portions 113 sidewardly extended at two sides to enlarge an area of the flat bottom surface 110, wherein two coupling holes are formed at the wing portions 113 of the base stand 111. It is worth mentioning that a length of the base stand 111, including the wing portions 113, is larger than a length of the raised member 112, i.e. also a length of the surrounding frame 12, for enabling the base stand 111 to be supported stably. In other word, the base stand 111 can be stably placed on a surface or mounted on the surface through the coupling holes via fasteners.

The surrounding frame 12 comprises two side members 121 upwardly extended from the base frame 11 and a top member 122 extended from the side members 121 to define an adjustment cavity 120 within the base frame 11, the side members 121 and the top member 122. Accordingly, the surrounding frame 12 generally has a rectangular shape that the side members 121 are upwardly, integrally, and perpendicularly extended from the raised member 112 of the base frame 11, and the top member 122 is horizontally and integrally extended between the side members 121 to parallel extend to the raised member 112 of the base frame 11. Therefore, the side members 121, the top member 122, and the raised member 112 form a rectangular configuration and define the adjustment cavity 120 therewithin.

According to the preferred embodiment, the sight adjustment module 20 comprises retention structure which comprises a base platform 30, two side clampers 40, and a top clamper 50, and an adjustment structure which comprises a sight adjuster 60.

Figure 3:
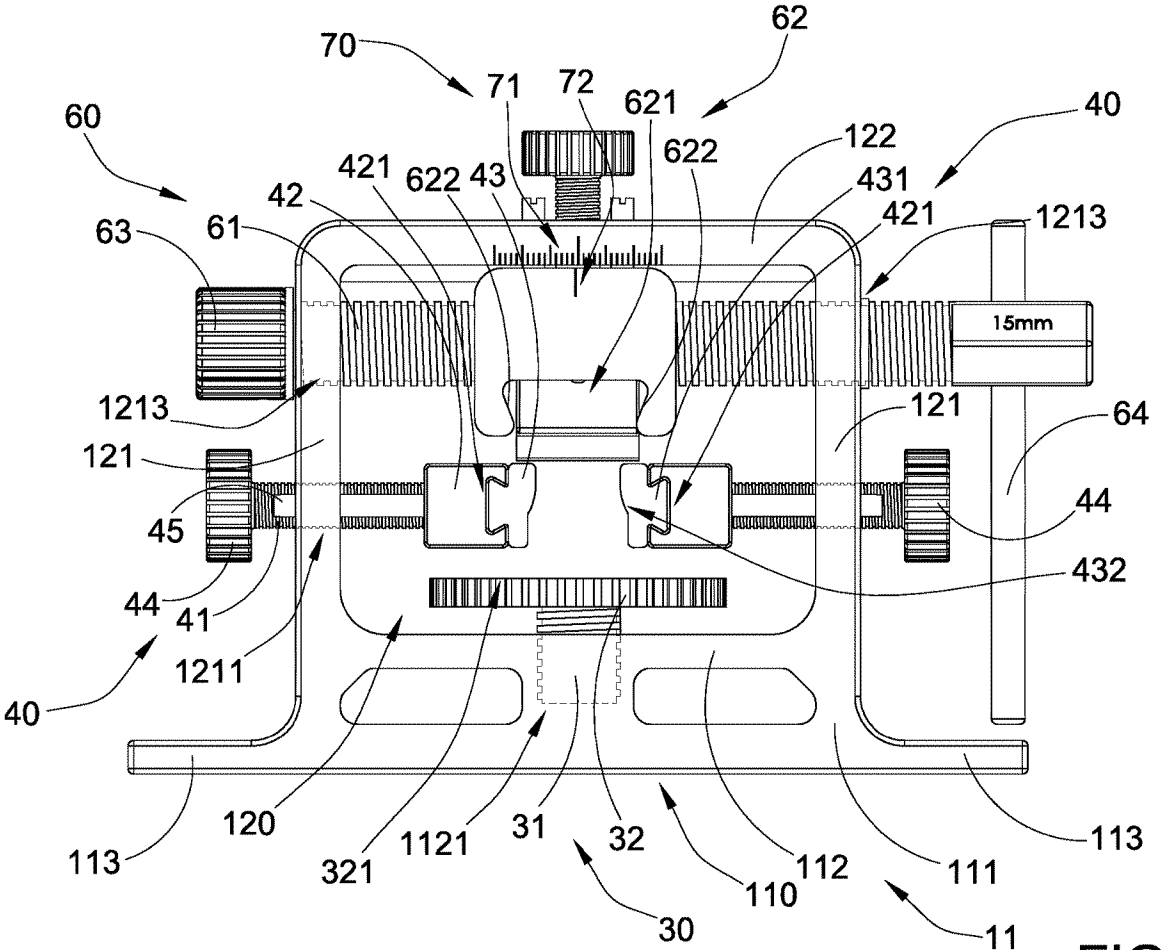
FIG. 3 is a front view of the sight adjustment tool according to the above preferred embodiment of the present invention.
Figure 4:
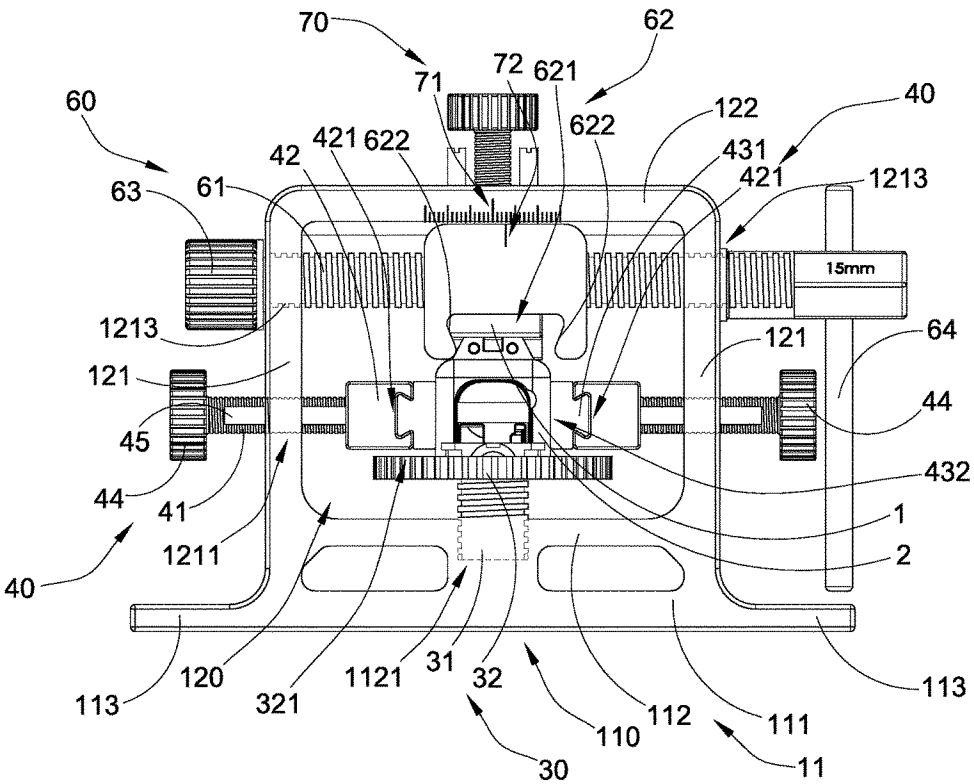
FIG. 4 is a front view of the sight adjustment tool according to the above preferred embodiment of the present invention, illustrating the pistol slide retained in the adjustment cavity.

The base platform 30 is movably supported on the base frame 11 within the adjustment cavity 120 in an elevated direction for adjustably supporting a bottom of the pistol slide 2. As shown in FIGS. 3 and 4, the base platform 30 comprises a base shaft 31 rotatably coupled at the base frame 11 without extending through the flat bottom surface 110 thereof, and a rotatable wheel 32 coaxially coupled at the base shaft 31 for supporting the bottom of the pistol slide on the rotatably wheel 32. In particular, the raised member 112 has an inner threaded base shaft slot which is a through slot formed at the raised member 112, wherein the base shaft 31 has an outer threaded structure rotatably coupled at the inner threaded base shaft slot 1121. It is worth mentioning that the base shaft 31 is rotatably coupled at the raised member 112 only without extending through the base stand 111, such that the base shaft 31 will not extended through the flat bottom surface 110. In other words, the bottom end of the base shaft 31 will only extended within the reinforcing cavity between the base stand 111 and the raised member 112.

The upper end of the base shaft 31 is coupled at a center of the rotatable wheel 32, wherein a top side of the rotatable wheel 32 forms a top platform surface 321 to support the bottom of the pistol slide 2. Accordingly, when the rotatable wheel 32 is rotated, the base shaft 31 is driven to rotate. Through the rotational movement of the base shaft 31, the rotatable wheel 32 is elevated or dropped down within the adjustment cavity 120. In other words, when the bottom of the pistol slid 2 is supported on the rotatable wheel 32, the position of the pistol slide 2 can be selectively adjusted within the adjustment cavity 120 in a vertical direction. Therefore, the base platform 30 provides a height adjustable platform, i.e. the top platform surface 321 of the rotatable wheel 32, to selectively adjust an elevated level of the pistol slide 2.

The side clampers 40 are movably extended from the side members 121 respectively to the adjustment cavity 120 for biasing against two sides of the pistol slide 2 respectively. Accordingly, the side clampers 40 are arranged for clamping at the sides of the pistol slide 2 to retain the pistol slide 2 within the adjustment cavity 120 in position. Each of the side clampers 40 comprises a side clamper arm 41 rotatably extended through the side member 121, a side clamping block 42 coupled at an inner end of the side clamper arm 41, and a side insert 43 detachably coupled at the side clamping block 42 for biasing against the side of the pistol slide 2 when the side clamper arm 41 is rotated.

As shown in FIGS. 3 and 4, each of the side members 121 has an inner threaded side arm slot 1211 which is a through slot formed at the side member 121, wherein the side clamper arm 41 has an outer threaded structure to rotatably engage with the inner threaded side arm slot 1211. Each of the side clampers 40 further comprises a side adjusting wheel 44 coaxially coupled at the side clamper arm 41. Accordingly, an outer end of the side clamper arm 41 is extended out of the adjustment cavity 120 through the side member 121, and the inner end of the side clamper arm 41 is extended within the adjustment cavity 120. The side adjusting wheel 44 is coupled at the outer end of the side clamper arm 41 and the side clamping block 42 is rotatably coupled at an inner end of the side clamper arm 41, such that when the side adjusting wheel 44 is rotated, the side clamper arm 41 is driven to rotate to move the side clamping block 42 at a horizontal direction. In other words, when the side adjusting wheel 44 is rotated, the side clamping block 42 is driven to move toward or away from the side of the pistol slide 2.

As shown in FIGS. 1 and 2, each of the side clampers 40 further comprises a side guiding arm 45 slidably extended from the side member 121 to couple at the side clamping block 42. Accordingly, when the side adjusting wheel 44 is rotated, the side clamper arm 41 is rotated to perpendicularly slide at the side member 121. As a result, the side clamping block 42 will be driven to rotate correspondingly. In order to prevent any rotational movement of the side clamping block 42 when the side clamper arm 41 is rotated, the side guiding arm 45 is extended to couple at the side clamping block 42 to ensure the linear movement of the side clamping block 42 within the adjustment cavity 120 without any rotational movement.

Each of the side members 121 further has a side guiding slot 1212, wherein the side guiding arm 45 is slidably passed through the side guiding slot 1212 to couple with the side clamping block 42. In one embodiment, two side guiding slots 1212 are formed at the side member 121 at a position that the inner threaded side arm slot 1211 is alignedly located between the two side guiding slots 1212. Two side guiding arms 45 are slidably passed through the side guiding slots 1212 to couple at the side clamping block 42, wherein the side clamper arm 41 is alignedly located between the side guiding arms 45. Therefore, when the side clamper arm 41 is rotated to adjustably move the side clamping block 42, the side guiding arms 45 will block the rotational movement of the side clamping block 42 during the position adjustment.

The side insert 43 is detachably coupled at the side clamping block 42 for biasing against the side of the pistol slide 2. Accordingly, the side insert 43 is made of rigid and scratch-free material, such as plastic, such that the side insert 43 is biased against the side of the pistol slide 2 without any scratch thereat.

According to the preferred embodiment, each of the side clamping blocks 42 has a side coupling slot 421, wherein the side insert 43 has one side configured to form a side coupling latch 431 detachably coupled at the side coupling slot 421 and an opposed side configured to have a side contouring surface 432 matching with a contour of the side of the pistol slide 2. As shown in FIGS. 3 and 4, the side coupling slot 421 has a dovetail shape, wherein the side coupling latch 431 is slidably and detachably fitted into the side coupling slot 421 so as to detachably couple the side insert 43 at the side clamping block 42. Accordingly, the user is able to change the side insert 43 corresponding to the contour of the side of the pistol slide 2. For example, the side contouring surface 432 of the side insert 43 has a curved configuration as shown in FIG. 3 while the side contouring surface 432 of the side insert 43 has a flat configuration as shown in FIG. 4. Therefore, the two side adjusting wheels 44 are rotated to drive the side clamper arms 41 to rotatably slide until the side contouring surfaces 432 of the side inserts 43 are biased against the sides of the pistol slide 2 respectively so as to securely clamp the pistol slide 2 between the two side clampers 40. It is worth mentioning that the pistol slide 2 is elevated by the base platform 30 until the sides of the pistol slide 2 are aligned with the side clampers 40 at the same horizontal level.

The top clamper 50, having the similar structural configuration of each of the side clampers 40, is movably extended from the top member 122 to the adjustment cavity 120 for biasing against a top side of the pistol slide 2.

Accordingly, the side clampers 40 and the top clamper 50 are arranged for clamping at the sides and the top side of the pistol slide 2 respectively to retain the pistol slide 2 within the adjustment cavity 120 in position. The top clampers 50 comprises a top clamper arm 51 rotatably extended through the top member 122, a top clamping block 52 coupled at a bottom end of the top clamper arm 51, and a top insert 53 detachably coupled at the top clamping block 52 for biasing against the top side of the pistol slide 2 when the top clamper arm 51 is rotated.

Figure 5:
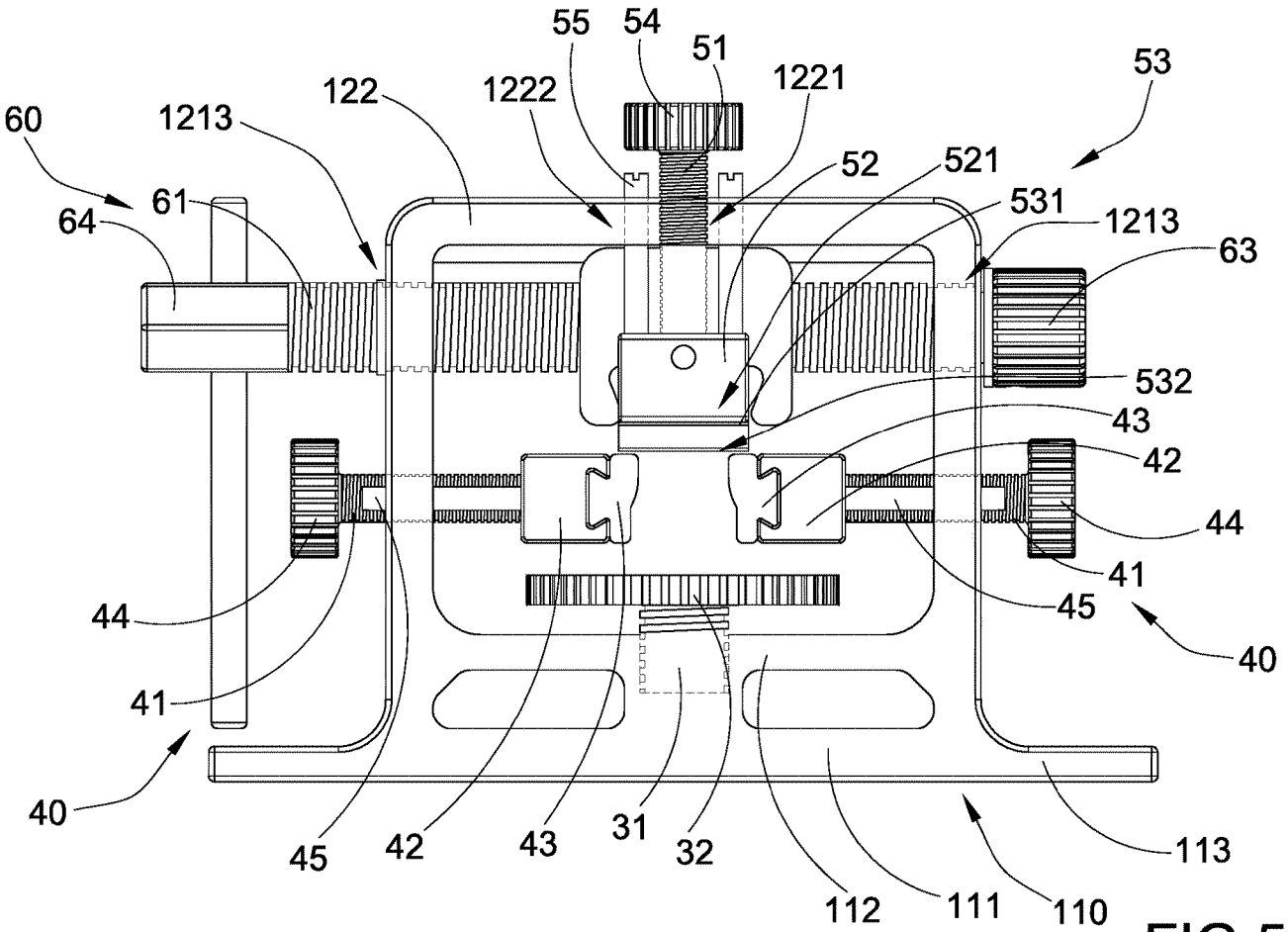
FIG. 5 is a rear view of the sight adjustment tool according to the above preferred embodiment of the present invention.
Figure 6:
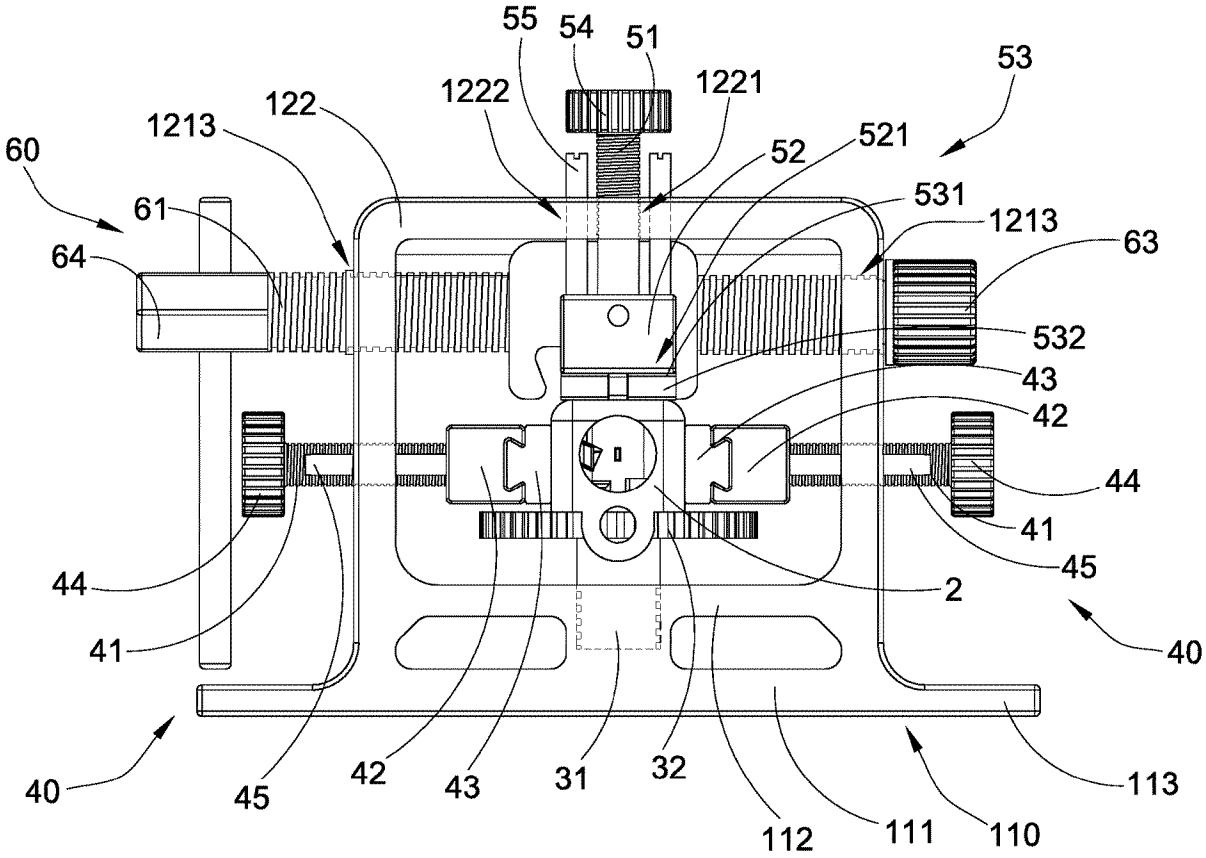
FIG. 6 is a rear view of the sight adjustment tool according to the above preferred embodiment of the present invention, illustrating the pistol slide retained in the adjustment cavity.

As shown in FIGS. 5 and 6, the top members 122 has an inner threaded top arm slot 1221 which is a through slot formed at the top member 122, wherein the top clamperarm 51 has an outer threaded structure to rotatably engage with the inner threaded top arm slot 1221. The top clampers 50 further comprises a top adjusting wheel 54 coaxially coupled at the top clamper arm 51. Accordingly, an upper end of the top clamper arm 51 is extended out of the adjustment cavity 120 through the top member 122, and the bottom end of the top clamper arm 51 is extended within the adjustment cavity 120. The top adjusting wheel 54 is coupled at the upper end of the top clamper arm 51 and the top clamping block 52 is rotatably coupled at the bottom end of the top clamper arm 51, such that when the top adjusting wheel 54 is rotated, the top clamper arm 51 is driven to rotate to move the top clamping block 52 at a vertical direction. In other words, when the top adjusting wheel 54 is rotated, the top clamping block 52 is driven to move toward or away from the top side of the pistol slide 2.

As shown in FIGS. 5 and 6, the top clampers 50 further comprises a top guiding arm 55 slidably extended from the top member 122 to couple at the top clamping block 52. Accordingly, when the top adjusting wheel 54 is rotated, the top clamper arm 51 is rotated to perpendicularly slide at the top member 122. As a result, the top clamping block 52 will be driven to rotate correspondingly. In order to prevent any rotational movement of the top clamping block 52 when the top clamper arm 51 is rotated, the top guiding arm 55 is extended to couple at the top clamping block 52 to ensure the linear movement of the top clamping block 52 within the adjustment cavity 120 without any rotational movement.

The top member 122 further has a top guiding slot 1222, wherein the top guiding arm 55 is slidably passed through the top guiding slot 1222 to couple with the top clamping block 52. In one embodiment, two top guiding slots 1222 are formed at the top member 122 at a position that the inner threaded top arm slot 1221 is alignedly located between the two top guiding slots 1222. Two top guiding arms 55 are slidably passed through the top guiding slots 1222 to couple at the top clamping block 52, wherein the top clamper arm 51 is alignedly located between the top guiding arms 55. Therefore, when the top clamper arm 51 is rotated to adjustably move the top clamping block 52, the top guiding arms 55 will block the rotational movement of the top clamping block 52 during the position adjustment.

The top insert 53 is detachably coupled at the top clamping block 52 for biasing against the top side of the pistol slide 2. Accordingly, the top insert 53 is made of rigid and scratch-free material, such as plastic, such that the top insert 53 is biased against the top side of the pistol slide 2 without any scratch thereat.

According to the preferred embodiment, the top clamping block 52 has a bottom coupling slot 521, wherein the top insert 53 has a top side configured to form a top coupling latch 531 detachably coupled at the bottom coupling slot 521 and a bottom side configured to have a bottom contouring surface 532 matching with a contour of the top side of the pistol slide 2. The top coupling slot 521 has a dovetail shape, wherein the top coupling latch 531 is slidably and detachably fitted into the bottom coupling slot 521 so as to detachably couple the top insert 53 at the top clamping block 52. Accordingly, the user is able to change the top insert 53 corresponding to the contour of the top side of the pistol slide 2. Therefore, the top adjusting wheel 54 is rotated to drive the top clamperarm 51 to rotatably slide until the bottom contouring surface 532 of the top insert 53 is biased against the top side of the pistol slide 2 so as to securely clamp on the pistol slide 2. It is worth mentioning that the top insert 53 is aligned with the base platform 30 in a vertical direction, such that the pistol slide 2 is sandwiched between the top insert 53 and the base platform 30. As a result, four sides of the pistol slide 2 are securely held by the rotatable wheel 32 of the base platform 30, the two side inserts 43 of the side clampers40, and the top insert 53 of the top clamper 50. Preferably, a plurality of insert sets are provided that each of the insert sets comprises two side inserts 43 and one top insert 53 for a particular pistol slide 2. Therefore, the user is able to select one insert set for clamping the pistol slide 2 within the adjustment cavity 120.

As shown in FIGS. 1 to 4, the sight adjuster 60 comprises a sight adjusting arm 61 rotatably extended between the side members 121 and an adjusting jaw 62 movably supported by the sight adjusting arm 61 and suspendedly supported within the adjustment cavity 120 for engaging with the sight element 1, wherein when the sight adjusting arm 61 is rotated, the adjusting jaw 62 is driven to slide along the sight adjusting arm 61 for selectively adjusting the position of the sight element 1 with respect to the pistol slide 2.

The sight adjusting arm 61 has a predetermined length larger than a distance between the two side members 121, i.e. the width of the surrounding frame 12, wherein two end portions of the sight adjusting arm 61 are extended out of the adjustment cavity 120 through the side members 121 respectively. Each of the side members 121 further has an inner threaded adjusting slot 1213 which is a through slot formed at the side member 121, wherein the sight adjusting arm 61 has an outer threaded structure to rotatably engage with the inner threaded adjusting slot 1213. The inner threaded adjusting slot 1213 is located above the inner threaded side arm slot 1211, such that the sight adjusting arm 61 is parallelly extended above the side clamper arms 41.

The sight adjuster 60 further comprises a driving wheel 63 and a hand crank 64 coupled at the end portions of the sight adjustment arm 61 respectively to drive the adjusting jaw 62 to move for engaging with and moving the sigh element 1 with respect to the pistol slide 2.

The adjusting jaw 62 has a dovetail shaped adjusting groove 621 formed at a bottom side of the adjusting jaw 62 for engaging with the sight element. The dovetail shaped adjusting groove 621 can engage with different shapes of the sight element 1. In particular, the adjusting groove 621 has two side edges 622, wherein a length of the adjusting groove 621 is larger than a width of the sight element 1, such that when the sight element 1 is disposed within the adjusting groove 621, the sight element 1 is located between the two side edges 622. Therefore, when the adjusting jaw 62 is moved along the sight adjusting arm 61, the sight element 1 is pushed by one of the side edges 622 of the adjusting groove 621 for selectively adjusting the position of the sight element 1 with respect to the pistol slide 2. For example, when the sight element 1 is needed to be moved to the left side with respect to the pistol slide 2, the adjusting jaw 62 must be driven to move at the left direction that the right side edge 622 of the adjusting groove 621 is biased against the right side of the sight element 1 to push the sight element 1 to the left. As shown in FIG. 6, the left side edge 622 of the adjusting groove 621 is biased against the left side of the sight element 1 to push the sight element 1 to the right.

It is worth mentioning that when the sight adjusting arm 61 is rotated by either the driving wheel 63 or the hand crank 64, the adjusting jaw 62 is driven to move along the sight adjusting arm 61. The driving wheel 63 can be rotated to rapidly rotate the sight adjusting arm 61 to move the adjusting jaw 62. When the sight element 1 is biased against one of the side edges 622 of the adjusting groove 621, the hand crank 64 can be used to drive the adjusting jaw 62 to further move. It is worth mentioning that the hand crank 64 requires less power to push the sight element 1.

As shown in FIGS. 3 and 4, a top surface of the adjusting jaw 62 is close enough to a bottom surface of the top member 122 to prevent the rotational movement of the adjusting jaw 62 when the sight adjusting arm 61 is rotated. In other words, when the sight adjusting arm 61 is rotated, the adjusting jaw 62 can only moved in a horizontal direction within the adjustment cavity 120.

It is worth mentioning that the adjusting jaw 62 and the top clamping block 52 are located at the upper portion of the adjustment cavity 120. In particular, the adjusting jaw 62 is located at a front side of the surrounding frame 12 and the top clamping block 52 is located at a rear side of the surrounding frame 12 at a position aligned with the adjusting jaw 62. Therefore, the adjusting jaw 62 can be moved horizontally and the top clamping block 52 can be moved vertically that the adjusting jaw 62 and the top clamping block 52 can be moved individually without interfering with each other. In other words, the top insert 53 is pressed against the top side of the pistol slide 2 at a position behind the sight element 1.

As shown in FIGS. 3 and 4, the sight adjustment module 20 further comprises an indication unit 70 for indicating the position adjustment of the sight element 1. The indication unit 70 comprises a plurality of degree indicators 71 provided at the top member 122 at the front side thereof, and a position indicator 72 provided at the adjusting jaw 62. Accordingly, the position indicator 72 is a mark formed at a centerline of the adjusting jaw 62, wherein when the adjusting jaw 62 is driven to move, the position indicator 72 is aligned with one of the degree indicators 71 to ensure the adjusting jaw 62 to be moved as indicated by the degree indicators 71 for accurately adjusting the position of the sight element 1.

In order to operate the sight adjustment tool of the present invention, the method of adjusting the position of the sight element 1 of the pistol slide 2 comprises the following steps.

(1) Select the corresponding side inserts 43 and top insert 53. Accordingly, the user is able to select the corresponding side inserts 43 and top insert 53 to be coupled at the side clamping blocks 42 and the top clamping block 52 respectively to match with the contour of the pistol slide 2.

(2) Secure the pistol slide 2 within the adjustment cavity 120. The user is able to elevate the top platform surface 321 at a predetermined level within the adjustment cavity 120 by rotating the rotatable wheel 32, such that when the bottom of the pistol slide 2 is placed on the top platform surface 321, the two sides of the pistol slide 2 alignedly face toward the side clampers 40 respectively. It is worth mentioning that the top platform surface 321 is lifted until the sight element 1 is aligned with and received in the adjusting groove 621.

The side clamping blocks 42 are driven to move toward the pistol slide 2 by rotating the side adjusting wheel 44 until the side contouring surfaces 432 of the side inserts 43 are biased against the sides of the pistol slide 2 respectively. Then, the user is able to drop down the top clamping block 52 by rotating the top adjusting wheel 44 until the bottom contouring surface 532 of the top insert 53 is biased against the top side of the pistol slide 2. Therefore, four sides of the pistol slide 2 are securely held within the adjustment cavity 120 by the rotatable wheel 32 of the base platform 30, the two side inserts 43 of the side clampers 40, and the top insert 53 of the top clamper 50.

(3) Adjust the position of the sight element 1 with respect to the pistol slide 2. Once the pistol slide 2 is secured within the adjustment cavity 120, the adjusting jaw 62 is moved to engage with the sight element 1 by rotating the driving wheel 63. Once the sight element 1 is engaged with the adjusting groove 621, the adjusting jaw 62 is further moved by the hand crank 64 to move the position of the sight element 1 by one of the side edges 622 of the adjusting groove 621. During the movement of the adjusting jaw 62, the position indicator 72 is moved correspondingly to align with one of the degree indicators 71 for accurately adjusting the position of the sight element 1.

It is worth mentioning that the user is able to use both hands to adjust the position of the sight element 1 by using one hand to hold the adjustment frame 10 and using the other hand to control the driving wheel 63 or the hand crank 64. Or, the user is able to place the adjustment frame 10 on the surface for position adjustment of the sight element 1. In addition, different sizes of sight element 1 can fit the dovetail shaped adjusting groove 621 since the sight element 1 is pushed by the side edge 622 of the adjusting groove 621. Therefore, the sight adjustment tool is considered as a universal adjustment tool for adjusting different sizes of sight elements on different types or size of pistols.

In addition, the sight adjustment tool can also remove the sight element 1 from the pistol slide 2 by moving the adjusting jaw 62 to push the sight element 1 until the sight element 1 is removed from the pistol slide 2. Likewise, the sight adjustment tool can also install the sight element 1 into the pistol slide 2 by moving the adjusting jaw 62 to push the sight element 1 coupled on the pistol slide 2 until the sight element 1 is adjusted to a desired position on the pistol slide 2.

Once the desired position of the sight element 1 is adjusted, the user is able to move the adjusting jaw 62 to disengage the sight element 1 with the adjusting groove 621. Then, the user is able to lift up the top clamping block 52 by rotating the top adjusting wheel 44 until the bottom contouring surface 532 of the top insert 53 is moved apart from the top side of the pistol slide 2. The side clamping blocks 42 are driven to move away from the pistol slide 2 by rotating the side adjusting wheel 44 until the side contouring surfaces 432 of the side inserts 43 are moved apart from the sides of the pistol slide 2 respectively. Then, the top platform surface 321 is dropped down until the sight element 1 is moved apart from the adjusting groove 621. As a result, the pistol slide 2 can be removed from the adjustment cavity 120.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sight adjustment tool for adjusting a position of a sight element on a pistol slide of a pistol, comprising:

an adjustment frame comprising an enlarged bottom base frame defining a flat bottom surface, and an upper surrounding frame integrally and upwardly extended therefrom, wherein said surrounding frame comprises two side members upwardly extended from said base frame and a top member extended from said side members to define an adjustment cavity within said base frame, said side members and said top member; and a sight adjustment module which comprises:

a base platform movably supported on said base frame within said adjustment cavity in an elevated direction for adjustably supporting a bottom of the pistol slide;

two side clampers movably extended from said side members respectively to said adjustment cavity for biasing against two sides of the pistol slide respectively;

a sight adjuster which comprises a sight adjusting arm rotatably extended between said side members and an adjusting jaw movably supported by said sight adjusting arm and suspendedly supported within said adjustment cavity, wherein said adjusting jaw has a dovetail shaped adjusting groove formed at a bottom side of said adjusting jaw for engaging with the sight element with various shapes, wherein when said sight adjusting arm is rotated, said adjusting jaw is driven to slide along said sight adjusting arm for selectively adjusting the position of the sight element with respect to the pistol slide; and a top clamper which comprises a top clamper arm rotatably extended through said top member within said adjustment cavity, a top clamping block coupled at said top clamper arm, and a top insert detachably coupled at said top clamping block for biasing against a top side of the pistol slide, wherein each of said side clampers comprises a detachable side insert detachably for biasing against a side of the pistol slide to match with a contour of said side of the pistol slide.

2. The sight adjustment tool, as recited in claim 1, wherein said base platform comprises a base shaft rotatably coupled at said base frame without being coupled to said flat bottom surface thereof, and a rotatable wheel coupled to said base shaft for supporting the bottom of the pistol slide on said rotatable wheel, such that when said rotatable wheel is rotated to drive said base shaft to rotate, said rotatable wheel is elevated or dropped down within said adjustment cavity.

3. The sight adjustment tool, as recited in claim 2, wherein said base frame comprises an enlarged base stand to define said flat bottom surface thereat, and a raised member upwardly and spacedly extended from said base stand, wherein said base shaft is rotatably coupled at said raised member only.

4. The sight adjustment tool, as recited in claim 3, wherein said base stand has two wing portions extended opposedly to enlarge and area of said flat bottom surface, wherein a length of said base stand is larger than a length of said surrounding frame for enabling said base stand to be supported stably.

5. The sight adjustment tool, as recited in claim 1, wherein each of said side clampers comprises a side clamper arm rotatably extended through said side member, and a side clamping block coupled at an inner end of said side clamper arm, and a wherein said side insert is detachably coupled at said side clamping block for biasing against the side of the side of the pistol slide when said clamper arm is rotated.

6. The sight adjustment tool, as recited in claim 3, wherein each of said side clampers comprises a side clamper arm rotatably extended through said side member, and a side clamping block coupled at an inner end of said side clamper arm, and a wherein said side insert is detachably coupled at said side clamping block for biasing against the side of the side of the pistol slide when said clamper arm is rotated.

7. The sight adjustment tool, as recited in claim 5, wherein each of said side clamping blocks has a side coupling slot, wherein said side insert has one side configured to form a side coupling latch detachably coupled at said side coupling slot and an opposed side configured to have a side contouring surface matching with a contour of the side of the pistol slide.

8. The sight adjustment tool, as recited in claim 6, wherein each of said side clamping blocks has a side coupling slot, wherein said side insert has one side configured to form a side coupling latch detachably coupled at said side coupling slot and an opposed side configured to have a side contouring surface matching with a contour of the side of the pistol slide.

9. The sight adjustment tool, as recited in claim 1, wherein said adjusting groove of said adjusting jaw has two side edges each inclined and extended inwardly and outwardly to form a dovetail shape, wherein a length of said adjusting groove is larger than a width of the sight element, such that when the sight element is disposed within said adjusting groove, the sight element is located between said two side edges, and that when said adjusting jaw is moved along said sight adjusting arm, the sight element is pushed by one of said side edges of said adjusting groove for selectively adjusting the position of the sight element with respect to the pistol slide.

10. The sight adjustment tool, as recited in claim 8, wherein said adjusting groove of said adjusting jaw has two side edges each inclined and extended inwardly and outwardly to form a dovetail shape, wherein a length of said adjusting groove is larger than a width of the sight element, such that when the sight element is disposed within said adjusting groove, the sight element is located between said two side edges, and that when said adjusting jaw is moved along said sight adjusting arm, the sight element is pushed by one of said side edges of said adjusting groove for selectively adjusting the position of the sight element with respect to the pistol slide.

11. The sight adjustment tool, as recited in claim 9, wherein said sight adjusting arm has two end portions extended out of said adjustment cavity through said side member respectively, wherein said adjuster further comprises a driving wheel coupled at one of said end portions of said sight adjustment arm to drive said adjusting jaw to move for engaging with the sight element, and a hand crank coupled at another end portion of said adjustment arm for moving the sight element with respect to the pistol slide.

12. The sight adjustment tool, as recited in claim 10, wherein said sight adjusting arm has two end portions extended out of said adjustment cavity through said side member respectively, wherein said adjuster further comprises a driving wheel coupled at one of said end portions of said sight adjustment arm to drive said adjusting jaw to move for engaging with the sight element, and a hand crank coupled at another end portion of said adjustment arm for moving the sight element with respect to the pistol slide.

13. The sight adjustment tool, as recited in claim 1, wherein said top clamping block is coupled at an inner end of said top clamperarm.

14. The sight adjustment tool, as recited in claim 12, wherein said top clamping block is coupled at an inner end of said top clamper arm.

15. The sight adjustment tool, as recited in claim 13, wherein said top clamping block has a bottom coupling slot, wherein said top insert has a top side configured to form a top coupling latch detachably coupled at said bottom coupling slot and a bottom side configured to have a bottom contouring surface matching with a contour of the top side of the pistol slide.

16. The sight adjustment tool, as recited in claim 14, wherein said top clamping block has a bottom coupling slot, wherein said top insert has a top side configured to form a top coupling latch detachably coupled at said bottom coupling slot and a bottom side configured to have a bottom contouring surface matching with a contour of the top side of the pistol slide.

17. The sight adjustment tool, as recited in claim 15, wherein said adjusting jaw is located at a front side of said surrounding frame and said top clamping block is located at a rear side of said surrounding frame at a position aligned with said adjusting jaw.

18. The sight adjustment tool, as recited in claim 15, wherein said adjusting jaw is located at a front side of said surrounding frame and said top clamping block is located at a rear side of said surrounding frame at a position aligned with said adjusting jaw.

19. The sight adjustment tool, as recited in claim 1, wherein said sight adjustment module further has a plurality of degree indicators provided at said top member to align with said adjusting jaw so as to ensure said adjusting jaw to be moved as indicated by said degree indicators for accurately adjusting the position of the sight element.

20. The sight adjustment tool, as recited in claim 1, wherein said sight adjustment module further has a plurality of degree indicators provided at said top member to align with said adjusting jaw so as to ensure said adjusting jaw to be moved as indicated by said degree indicators for accurately adjusting the position of the sight element.

* * * * *